US006199821B1

(12) United States Patent
Job

(10) Patent No.: US 6,199,821 B1
(45) Date of Patent: Mar. 13, 2001

(54) SUPPORT AND BARRIER RING

(76) Inventor: Donald D. Job, P.O. Box 3332, Nashua, NH (US) 03061-3332

( * ) Notice: Subject to any disclaimer, the term of this patent is extended or adjusted under 35 U.S.C. 154(b) by 0 days.

(21) Appl. No.: 08/599,647

(22) Filed: Feb. 12, 1996

(51) Int. Cl.[7] ..... F16M 11/00
(52) U.S. Cl. ..... 248/682; 248/688
(58) Field of Search ..... 248/682, 688, 248/687, 314, 315, 633; 15/435, 443, 437

(56) References Cited

U.S. PATENT DOCUMENTS

| | | | | |
|---|---|---|---|---|
| D. 351,065 | * | 10/1994 | Lee | D4/135 |
| D. 362,550 | * | 9/1995 | Narubin | D4/135 |
| 569,936 | * | 10/1896 | Potter | 248/688 |
| 1,386,526 | * | 8/1921 | Owen | 15/435 |
| 1,501,020 | * | 7/1924 | Small | 15/248.1 |
| 2,161,854 | * | 6/1939 | Copell | 248/315 |
| 2,169,965 | * | 8/1939 | Niedermaier | 248/314 |
| 2,593,913 | * | 4/1952 | Oscher | 248/682 |
| 2,722,703 | * | 11/1955 | Green | 15/143 |
| 3,968,950 | * | 7/1976 | Gallo | 248/688 |
| 4,170,333 | | 10/1979 | Angelastro | 248/110 |
| 4,770,379 | | 9/1988 | Estvold | 248/110 |
| 4,911,187 | | 3/1990 | Castillo | 132/321 |
| 4,973,018 | | 11/1990 | Agor | 248/309.1 |
| 4,979,708 | | 12/1990 | Aoki | 248/110 |
| 4,995,509 | | 2/1991 | Kornfeind | 206/209.1 |
| 4,995,511 | | 2/1991 | Evans | 206/262.1 |
| 5,072,904 | | 12/1991 | Taylor | 248/110 |
| 5,085,386 | | 2/1992 | Hicks | 248/110 |
| 5,107,984 | | 4/1992 | Weischoff | 206/45.13 |
| 5,143,463 | * | 9/1992 | Pozil | 15/443 |
| 5,188,242 | * | 2/1993 | Smith | 211/69 |
| 5,272,784 | | 12/1993 | Levin | 15/167.1 |
| 5,305,491 | | 4/1994 | Hegemann | 15/167.2 |
| 5,313,684 | | 5/1994 | Fitjer | 15/167.1 |
| 5,443,735 | | 8/1995 | Kirnbauer et al. | 210/668 |
| 5,462,714 | | 10/1995 | Talwalker et al. | 422/37 |
| 5,468,083 | * | 11/1995 | Chesar | 15/437 |
| 5,592,244 | * | 1/1997 | Vyhmeister | 248/309.1 |
| 5,607,343 | * | 3/1997 | Keith, Jr. et al. | 451/344 |
| 5,752,938 | * | 5/1998 | Flatland et al. | 604/167 |

OTHER PUBLICATIONS

Inventor's Digest, Jan./Feb., 1994, p. 30 re: Pending Application of John Arata.

* cited by examiner

*Primary Examiner*—Anita M. King
*Assistant Examiner*—Gwendolyn Baxter

(57) ABSTRACT

Removable ring shaped attachments around handles provide positioning in support racks, prevents running of liquids from one end of device to another, facilitates cleaning support devices and for brushes, facilitates drying of brush bristles.

2 Claims, 9 Drawing Sheets

SUPPORT AND BARRIER RING

A portion of this patent document contains material which is subject to copyright protection. The copyright owner has no objection to the facsimile reproduction by anyone of the patent disclosure, as it appears in the Patent and Trademark Office patent files or records, but otherwise reserves all copyrights whatsoever.

FIELD OF THE INVENTION

This invention relates generally to devices which encircle handles to provide positioning in support racks, devices which inhibit liquids from running from one end of device to another, thereby facilitating cleaning of supports and in the case of brushes to facilitate drying of brush bristles.

BACKGROUND OF INVENTION

A number of devices are available for holding tools, instruments and equipment having handles. For example Angelastro, in U.S. Pat. No. 4,170,333, incorporated herein by reference, discloses an elastic band with a twist for garden tools such as shovels, hoes and household devices as brooms. Other devices use spring clips or the like to grip handles of implements and hold them in an upright fashion, such as U.S. Pat. No. 4,165,550 for a mop holder.

There are often problems related to ease of: attachment of devices to handles; engagement with holder between uses and disengagement from holder during use.

For toothbrushes there are additional unique requirements. The first that most holders accommodate toothbrushes such that the head of the brush rests on the holder itself. This creates two problems: first, liquid residue from the brush puddles on the holder, keeping some bristles moist which shortens the effective life of the bristles—they get too soft. This puddle of moisture provides a support medium for micro-organism growth. Sweeteners found in most toothpastes as well as organic compounds found in saliva from the mouth offer nutrients for growing micro-organisms. Micro-organisms and food particles can come from the mouth of the user and from the surrounding air in the bathroom. Both can contribute to the growth of organisms and transmission of disease. Micro-organisms from the air or water may include bacteria, molds, mildew and viruses. U.S. Pat. No. 5,443,735 to Kirnbauer, et al. discusses growth of micro-organisms on filter media that arise from household water supplies.

To prevent contamination problems some inventions have built into the storage device or holder capability to disinfect brushes. In a pending U.S. patent application by John P. Arata (as reported in *Inventor's Digest* January/February, 1994 p. 30) uses ultraviolet light and a bactericide dispensing mechanism for each brush. This approach is expensive and requires specially grounded electrical sources which is not always available in older bathrooms. Use of bactericides also raises safety issues since toxic material could end up in people's mouths. A broad treatment of the art for antimicrobial compositions and some of the problems associated therewith may be found in U.S. Pat. No. 5,462,714 issued to R. Talwalker and S. Barve. In U.S. Pat. No. 4,995,509 Kornfeind presents an alternative, which is to make the storage device disposable. While this may be suitable in some instances it does not meet the need for many whose bathrooms are considered designer showplaces, and creates environmental issues.

A second problem with current practice is that drainage from the toothbrush accumulating on the support device, often runs down the inner surfaces of the holder and become encrusted thereon. This encrustation can be very difficult to remove under common cleaning practices. Kornfeind's U.S. Pat. No. 4,995,509 addresses this need also; but, again falls short for the reason cited above. U.S. Pat. No. 4,770,379 by Estvold also teaches a disposable toothbrush holder.

Returning to the first problem, some toothbrushes have an expanded portion to the handle which prevents it from going all the way down into a holder. See FIG. 1 of a toothbrush design by Acumen Co. Ltd. of Taiwan, a major supplier. However, the primary purpose of such expanded portion is to provide a grip, not to lift the brush higher in the holder. Furthermore, the expanded portion is not suitable for some because it does not fit into some toothbrush holders having smaller openings. Other examples of handle designs may be found in U.S. Pat. No. 5,272,784 by Levin and U.S. Pat. No. 5,305,491 by Hegemann showing a self adjusting three-headed toothbrush.

Many holder designs address ease-of-use and aesthetics but do not address cleaning and contamination problems. For example, U.S. Pat. No. 4,979,708 to Aoki et al. shows novel design features, but it is of no value in solving the aforementioned problems. Other examples of supports are: U.S. Pat. No. 4,973,018 to Agor; U.S. Pat. No. 5,313,684 to Fitjer and U.S. Pat. No. 4,995,511 to Evans which combines a toothbrush holder with a toothpaste holder.

While these problems have been described in relation to a toothbrush, there are similar problems with other devices including dental tools and instruments. U.S. Pat. No. 4,911,187 to Castillo shows a dental pick brush having a contoured handle for the stated purpose of ease of manipulation.

A problem of storing paint brushes is indicated in U.S. Pat. No. 5,072,904 to Taylor wherein the issue of draining of wet paint onto the handles is addressed. Taylor's solution is to hold the brushes horizontally. The solution of Hicks and Hodgins in U.S. Pat. No. 5,085,386 is to provide a holder which attaches to an open paint can thus being useful only during use, not during storage. Brushes and applicators used for applying cosmetics also presents a storage problem. For example, in U.S. Pat. No. 5,107,984 to Weischoff, the end of an applicator sponge or brush is returned to a receptacle after use for storage in a case. The receptacle prevents loss of material to surroundings but does not aid in drying the applicator nor in preventing the growth of microorganisms.

While microbial contamination may not be a problem in some arts, ease of maintenance of holders and extension of life of tools, particularly brushes is a common problem. The solutions presented in the patent literature have various drawbacks.

SUMMARY OF INVENTION

It is an object of this invention to provide a barrier between heads of instruments and brushes and support surface so as to eliminate puddling of liquid on the support surface.

It is further an object of this invention to reduce micro-organism growth and reduce the necessity for cleaning scale and related debris from support devices such as toothbrush holders.

It is further an object of this invention to promote air drying of brush bristles between uses by elevating bristles above support surfaces. One benefit of promoting drying between uses is to extend the effective life of bristles.

A further object is to reduce accumulation of particles and encrustation on holders and/or dripping of same below the handle to surfaces below such as a sink or floor. All these contribute to reduced maintenance effort.

The present invention addresses: that most holders accommodate toothbrushes such that the head of the brush rests on the holder itself resulting in puddles on the holder, keeping some bristles moist which shortens the effective life; reducing microorganism growth without the addition of possibly toxic materials; and reducing encrustation from drainage from the tools such as toothbrushes on the inner surfaces of the holder.

DESCRIPTION OF INVENTION

This invention approaches the problems identified above by providing a device which can easily attach to most brush handles and hold bristles out of water accumulating on the holder. Thus, whether the handle was of the type shown in FIG. 1 or in U.S. Pat. No. 5,305,491 to Hegemann with a built in expanded portion or of the type exemplified in U.S. Pat. No. 5,272,784 to Levin having approximately straight sides for the length of the handle, the device will fit and is adjustable between brushes.

Figure 1:
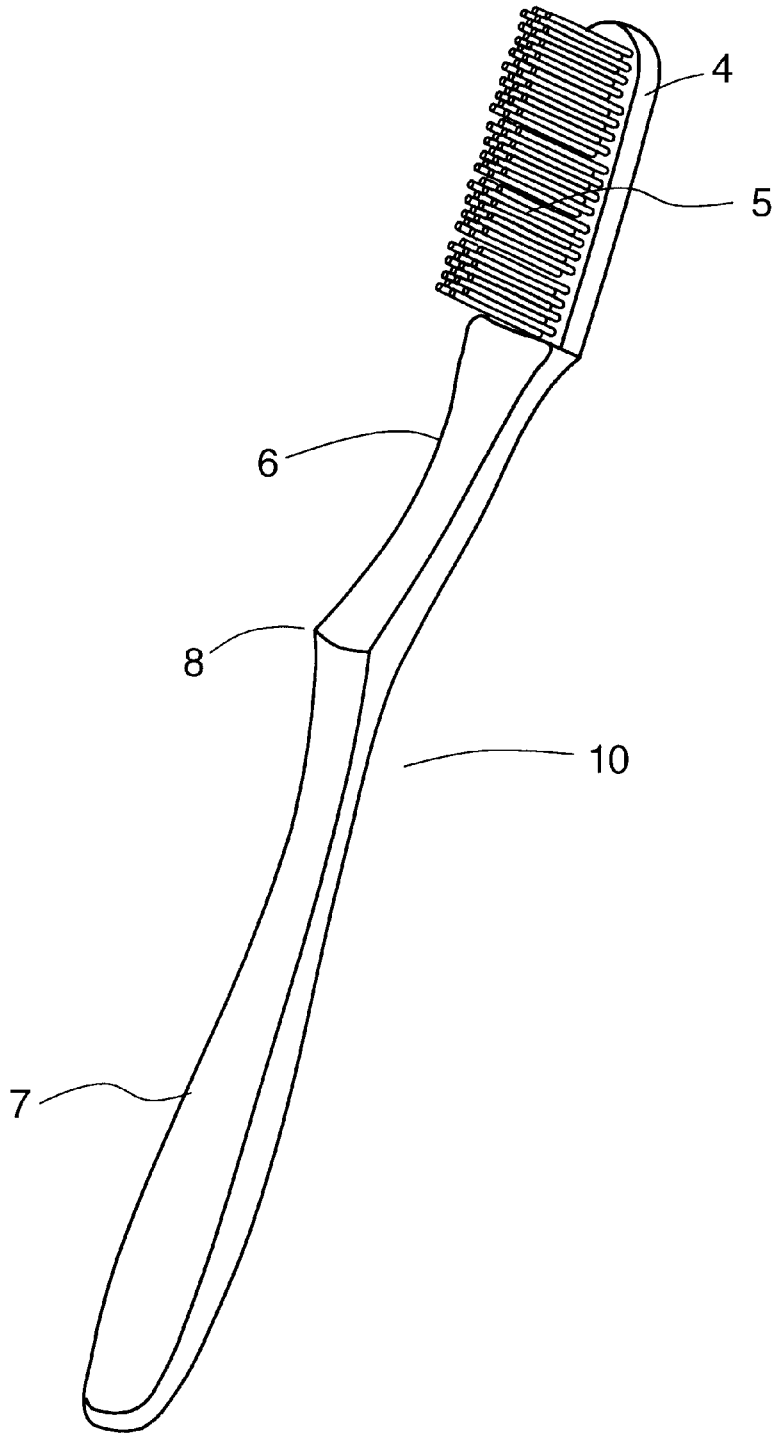
FIG. 1 is a perspective view of the form of a commercially available toothbrush.

FIG. 1 shows a perspective view of a toothbrush 10 having an elongated handle 7, an expanded region 8, a neck region 6 and a head 4 containing bristles 5. The expanded region 8 is characteristic of many manufactured by Acumen Co. Ltd. of Taiwan, a major supplier.

Figure 2:
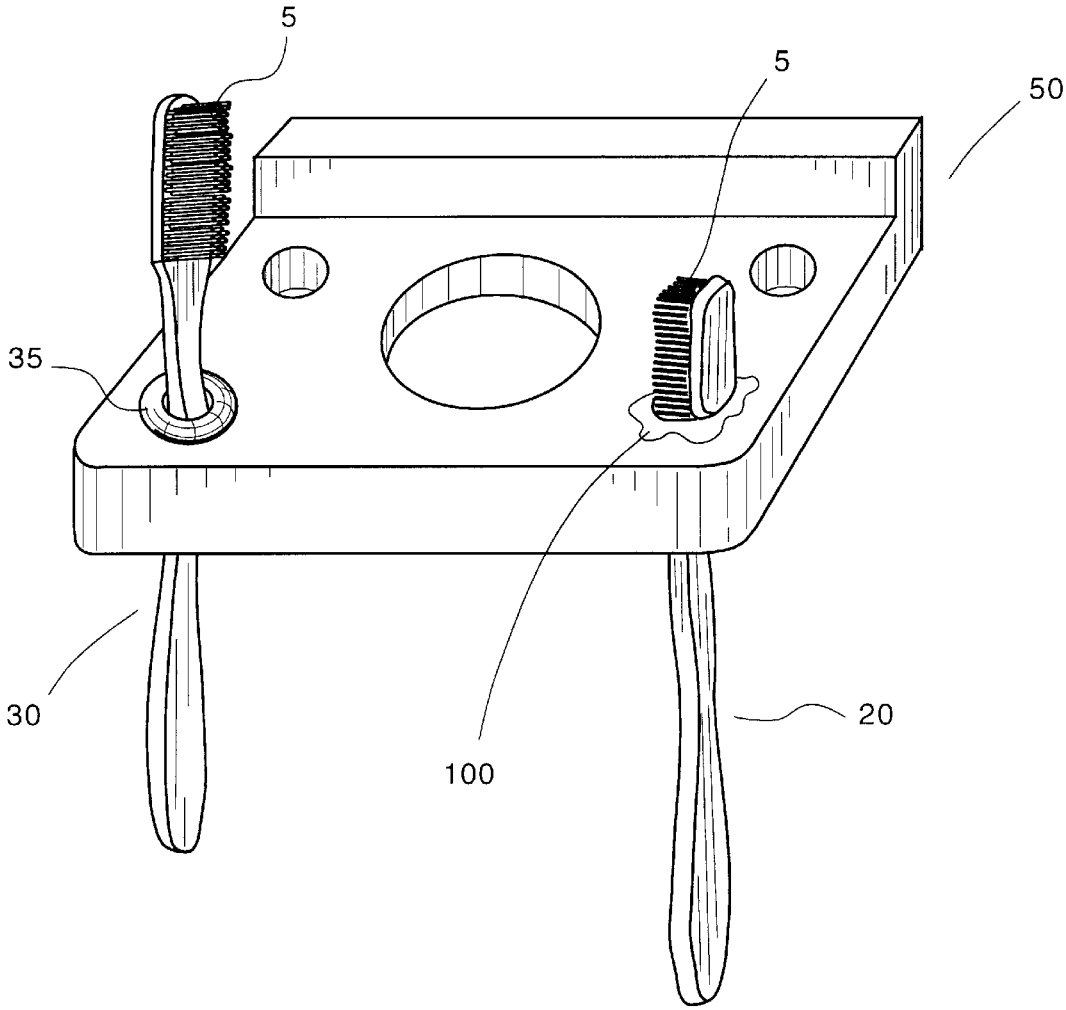
FIG. 2 is a perspective view of a previously demonstrated device in the shape designate s o-o ring on a handle in a holder.

FIG. 2 shows an O-O ring on a handle in a holder 50, as was displayed by the inventor at the Inventor's Weekend held in 1993 in Cambridge, Mass. The designation used in the description of rings here is that the first letter describes the shape of a cross-section of the ring, and the second letter describes the shape of a top view of the ring. A first brush 30 is provided with an O-O ring 35 and a second brush 20 without the benefit of a ring, rests in a puddle of water 100 surrounding bristles 5 on the holder 50.

Initially, commercially available O-O rings were tried, however, these rings function differently from the present invention. The purpose of such commercially available rings, is to provide a compressible seal, not to hold an object or to prevent flow down the surface of a handle. They are generally formed by cutting lengths of cylindrically extruded material and butt sealing ends together; or by forming in an array of molds. Elasticity of commercially available O-O rings such as those formed from BUNA-N (nitrile), neoprene (chloroprene), or Viton (a fluoroelastomer) is unsatisfactory for the present invention and providing the very high chemical resistance characteristic of the foregoing is unnecessarily expensive. Because of the different function, it was impossible to find commercial O-O rings having sufficiently small diameters (in the range of 0.63+/−0.08 cm) while retaining relatively large cross sections (in the range of 0.47+/−0.13 cm) and a broad range of extensibility (in the range of 100–300%). Extensibility is critical for ease of fitting over a broad range of handle sizes and shapes. Small diameter is important to obtain a snug fit. A large cross section is important in order to prevent the handle from slipping through a wide range of hole sizes in holders. A large cross-section also helps support bristles away from a horizontal surface if a brush is stored horizontally, as on a shelf (See FIG. 6D).

Additionally a problem encountered in using commercially available O-O ring devices is accumulation of material in the sulcus formed between the inside of the ring and the handle. While the O-O device addressed some problems, it did not address cleaning of the brush handle.

Figure 3A:
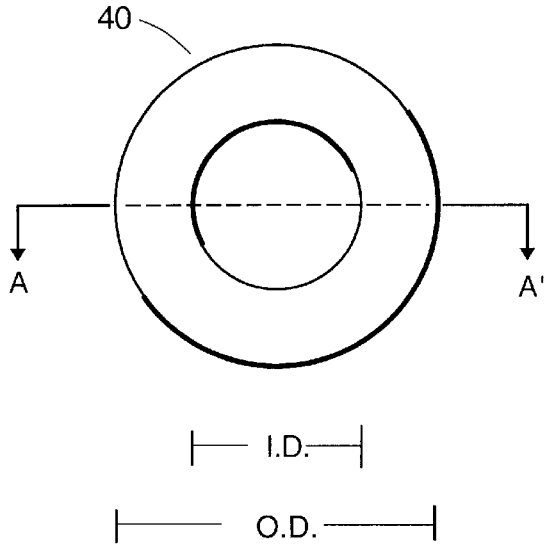
FIGS. 3A, 3B, and 3C are top, side and cross-sectional views respectively of an embodiment of the invention designated as R-O ring.
Figure 3B:
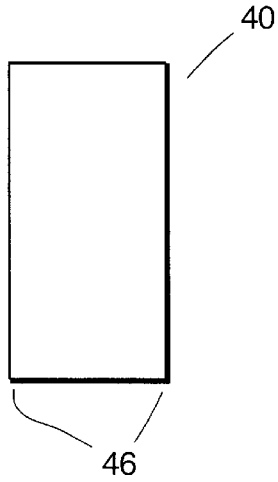

These constraints lead to development of R (rectangular)-O rings formed from die cutting sheets of elastomeric material as latex as shown in FIGS. 3A top, 3B side, and 3C cross-sectional views of an R-O ring 40, a first embodiment of the invention having a square cross-section. In FIG. 3A R-O ring 40 is shown from the top. The A–A' lines indicate where the cross section is taken for FIG. 3C. In FIG. 3B, R-O ring 40 is shown from the side indicating the square corners 46.

Figure 3C:
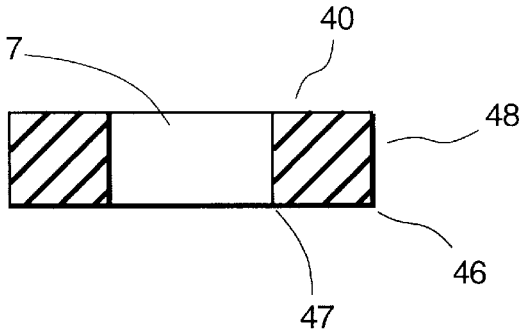

As illustrated in FIG. 3C, by creating a ring with a flat inner surface 47, a seal is formed between the R-O ring 40 and the brush handle 7, thereby preventing accumulation in small openings. By having relatively square inner corners 47, accumulation of material between the handle and ring is reduced. Cleaning is thereby made easier. The square outer corners 46 are a consequence of the way the ring is formed from cutting a tubal section cross-wise.

Figure 4:
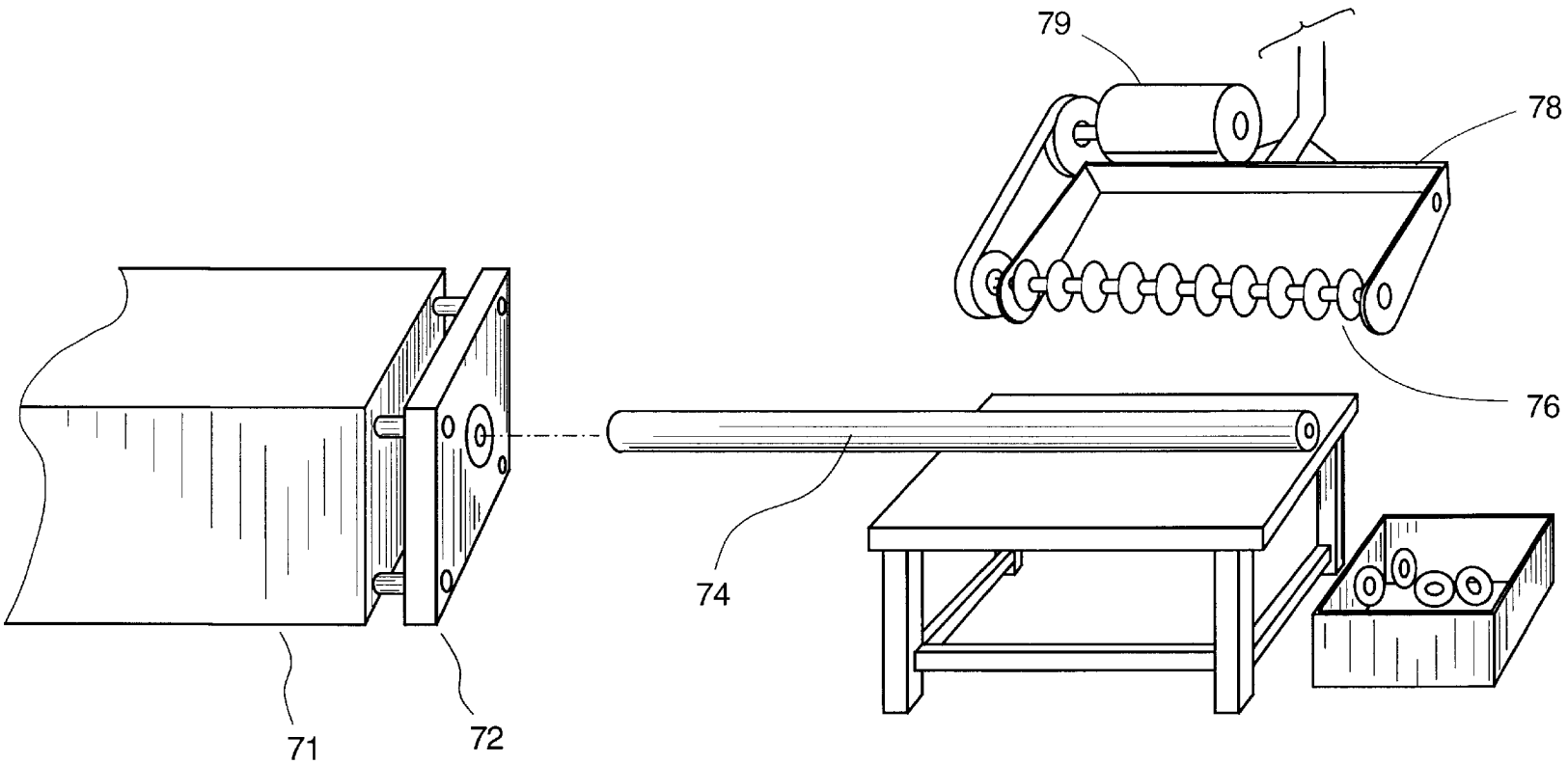
FIG. 4 is a perspective view showing production by extrusion and cutting.

The die-cutting approach, however, leads to a lot of scrap material, making it more costly. An alternative method is to cut sections from tubing which has been extruded. FIG. 4 shows elements of an alternative method for production; namely by extrusion and cutting. An extrusion apparatus 71 forces raw material through a die plate 72 having the desired shape and dimensions to form an extruded linear piece 74. This linear extrusion is then cut into appropriately thick slices by cutting wheels 76 supported on an arm 78 which is connected to a pneumatic, hydraulic or such mechanisms to move the cutting wheels 76 through the tubing 74. In the illustration of FIG. 4, an electric motor 79 drives the cutting wheels 76. Rings are fabricated from tubing that is cut. Latex tubing is used to produce a ring having a satisfactory size and elasticity. While this solves the scrap problem, it still produces square edges which can be more difficult to clean.

Figure 5A:
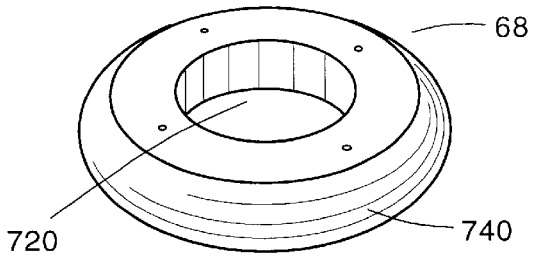
FIGS. 5A, 5B, 5C and 5D are perspective, top, side and cross-sectional views respectively of a second embodiment of the invention designated as a D-O ring.

This lead to a refinement shown in FIGS. 5A (perspective), 5B (top), 5C (side) and 5D (cross-section) for a moldable part having the D-shaped cross-section. In FIG. 5A D-O ring 68 is seen to be comprised of an opening 720 and a circular outer edge 740. Pins used for ejection from a mold leave imprints indicated as 61 in ring 68 of FIG. 5B. The outer diameter (O.D.) of the ring is 1.27+/−0.076 cm and the inner diameter (I.D.) is 0.63+/−0.05 cm in its resting state. A D-O ring 68 is shown in FIG. 5C looking from the side. Here the curved outer edge 69 may be seen in relation to an otherwise flat surface 65. Thickness ("IT") of ring 68 in 5C is 0.38+/−0.076 cm.

Figure 5B:
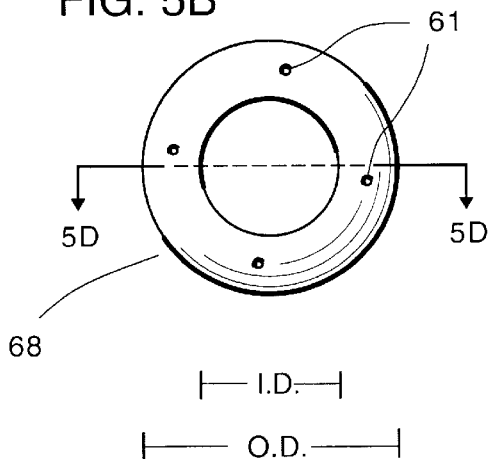
Figure 5C:
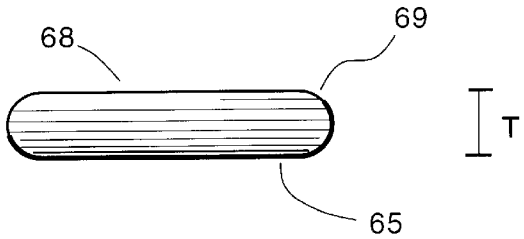
Figure 5D:
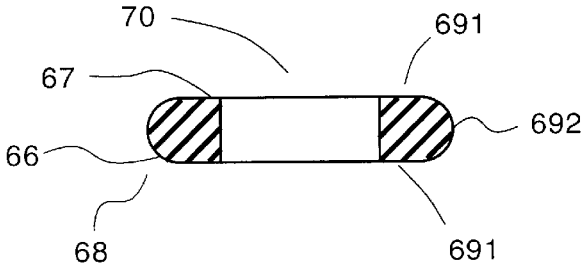

The cross sectional view of FIG. 5D is taken at A–A' as indicated in top view FIG. 5B. The shape of the cross-section of ring 68 is seen to be comprised of a straight portion 691 and a non-straight curved portion 692, the latter having a radius of curvature of 0.20+/−0.05 cm. A right square angle between the ring 68 and the handle 70 is retained, but there is a finite radius 66 to the outer edge of the ring. Alternative cross-sections would be in the shape of a parabola, an elipse or other combination of straight and curved portions depending in part on ease of fabrication and cost for tools and molds. For example, FIGS. 6A–6D show a third cross-sectional shape, triangular (designated "T-NC" where NC refers to the non-circular shape of the outer perimeter).

Figure 6A:
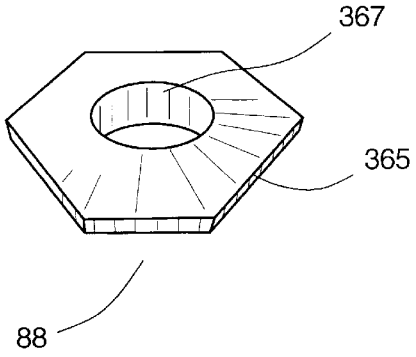
FIGS. 6A, 6B, 6C, and 6D are perspective, top, cross-sectional and perspective views respectively of a third embodiment of the invention designated as a T-O ring.

In FIG. 6A an alternative perimeter is illustrated in perspective. In this case the perimeter is hexagonal rather than circular. The inner surface 367 of ring 88 has a circular shape and the outer surface 365 is comprised of three or more straight segments 375. A top view is provided in FIG. 6B wherein one sees more clearly that there are six such straight segments 375. The function of providing straight segments on the ring is so that it will not roll across a surface as when stored in a horizontal position as illustrated in perspective in FIG. 6D. Such functionality can be achieved by providing any number of such straight segments. Such shapes can be readily molded as by an injection molding machine with the appropriate molds.

Figure 6B:
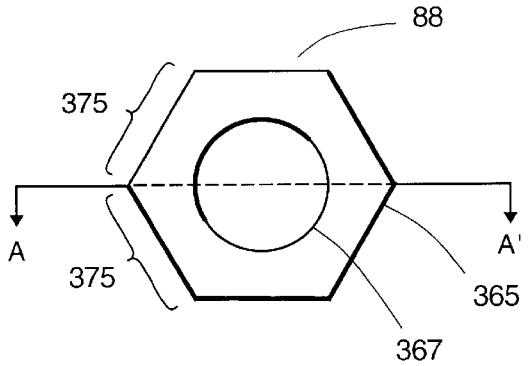
Figure 6C:
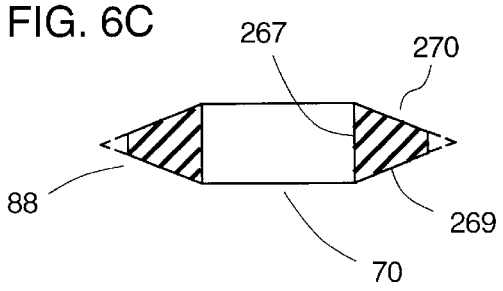

FIG. 6C shows the cross-sectional view A–A' taken from FIG. 6B wherein the handle 70 of brush is seen encompassed by a ring 88 comprised of three straight sides, one 267 touching the handle, and the other two, 269 and 270 intersecting each other at some distance away from the handle.

Figure 6D:
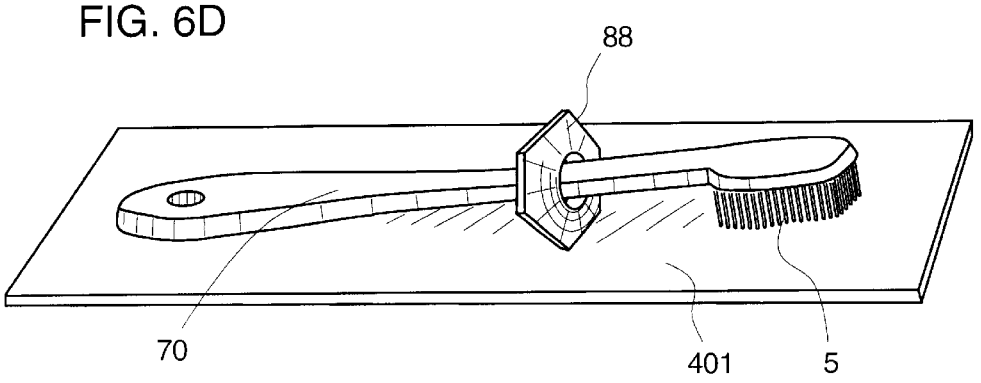
Figure 7A:
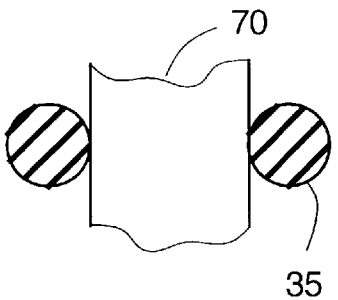
FIGS. 7A, 7B, 7C, and 7D show cross sections of different embodiments when applied to a handle.
Figure 7B:
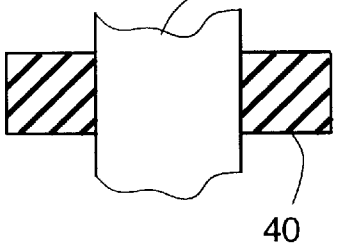
Figure 7C:
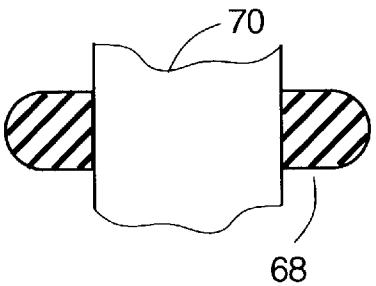
Figure 7D:
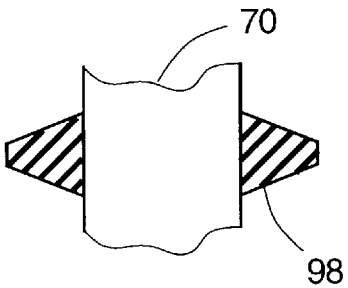

FIG. 6D, a perspective view of a brush 70 stored in a horizontal position on a flat surface 401 as a shelf. The T-NC ring 88 is of sufficient size and is positioned sufficiently close to the bristle end of the brush to hold bristles away from surface 401 regardless of which way bristles are oriented.

While the dimensions given above are appropriate for toothbrush handles, functionality for smaller or larger tool handles depends upon proper sizing of the adapter rings. Rings should have sufficiently small inner diameters to form a firm fit on the handle and a sufficiently large outer diameter to prevent the flow of fluid down the handle and to engage the surface of openings in the support rack. When the handle is stored horizontally on a surface (as on a shelf) the outer diameter of the ring needs to be sufficient to lift the working end of the tool away from the surface. In the case of brushes, additional allowance for drooping of wet bristles is suggested. It is also noted that while we speak of "rings", this does not necessarily imply circular perimeters. In fact in actual usage, the shapes of the handles fitted with these rings may be circular, oval, rectangular, square, hexagonal or other multi-sided or irregular shapes.

A broad range of extensibility (about 75–300%) is important for ease of fitting over a broad range of handle sizes and shapes. Small inner diameter is important to obtain a snug fit. A relatively large cross section is important to prevent a handle from slipping through a wide range of openings in holders.

FIG. 7 summarizes different cross sections of embodiments of this invention as applied to a handle 70. FIG. 7A shows the cross section of an O-O ring 35 applied to a handle. FIG. 7B shows the cross section of an R-O ring 40. FIG. 7C shows the cross section of a D-O ring 68. The curved portion may circumscribe portions of a circle, an elipse, a parabola or combinations of curvatures. FIG. 7D shows a cross section of a T-O (triangular) shaped ring 98. Thus, the shape of the cross sections is seen to be variable just as is the shape of the perimeter.

Figure 8:
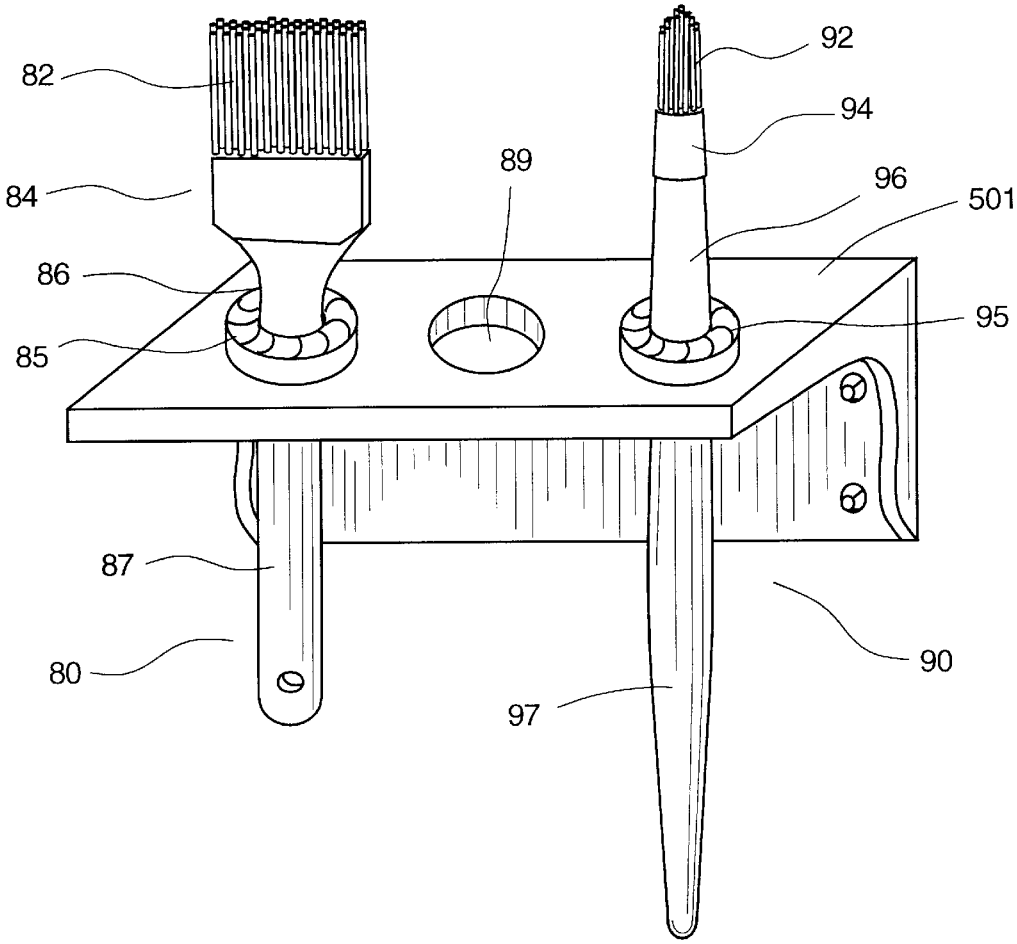
FIG. 8 is a perspective view of the invention used with a variety of brush handles.

FIG. 8 shows perspective views of invention applied to other types of handles. A broad bristled 82 paint brush 80 is comprised of a head portion 84 which holds the bristles 82 and attaches on the other end to the neck 86 of the handle 87. The retaining/support ring 85 is slipped over the end of the brush 80 and positioned near the neck 86. The brush is then supported in a raised position when placed in one of the openings 89 of a rack 501. A smaller brush 90 is similarly comprised of the bristles 92 secured in the head 94 which in turn is attached to the neck 96 of the brush 90. The retaining/support ring 95 is placed over the handle 97 and slid to near the neck 96 of the handle. The brush is then supported in a raised position when placed in one of the openings 89 of the rack 501.

Figure 9:
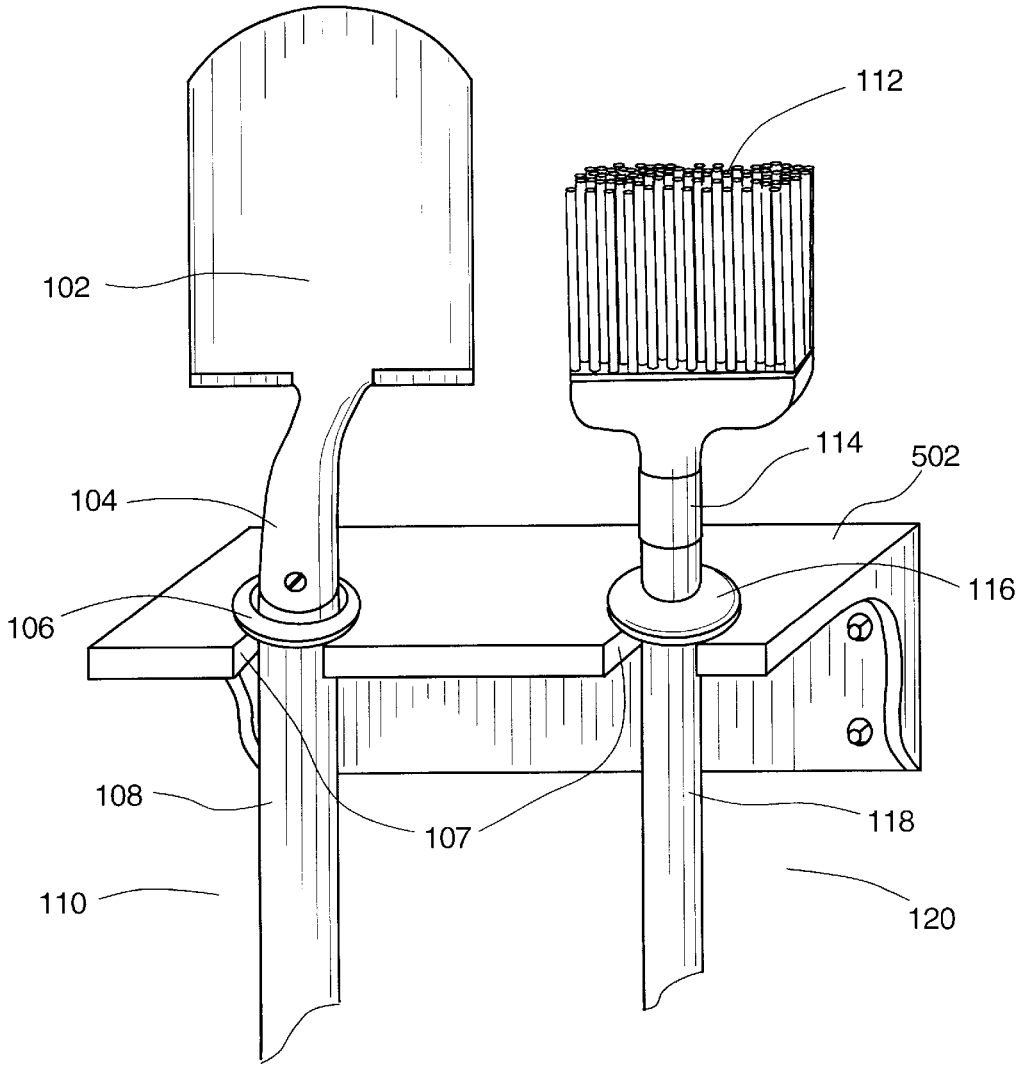
FIG. 9 is a perspective view of invention used with a variety of other types of tools.

FIG. 9 shows a perspective view of invention applied to handles of garden or maintenance implements. A shovel 110 may be secured in rack 502 which has open slots 107 by sliding a ring 106 over the handle 108 to near the neck 104 of the shovel. Any moisture on the shovel blade 102 is deflected from running down the handle 108 when the ring 106 is in place. Additionally, position of the tool in the rack can be adjusted according to rack height, length of handle, etc. In like manner, a broom 120 may be secured in rack 502 by sliding a ring 116 over the handle 118 up near the neck 114 of the broom. Any moisture in broom bristles or mop fabric 112 is deflected from running down the handle 118 when the ring 116 is in place.

Appropriate selection of materials for the components in the various forms described is an important part of the functionality of the invention. It is important to have a balance between rigidity, flexibility, lack of toxicity, durability and moldability. Our experience indicates that a number of different thermoplastics, thermosetting plastics and rubbers meet these requirements. However, among these, the thermoplastic elastomers such as sold under the trademark GEOLAST and SANTOPERNE by Advanced Elastomer Systems, L.P. and KRATON(TM) by Shell Chemical Co. are particularly well suited. Among the KRATON polymer options are FDA approved, colorable resins of the styrene-butadiene-styrene block type and styrene-isoprene-styrene for KRATON D series and styrene-ethylene/butylene-styrene type for the KRATON G series. These are also recyclable and KRATON G can be steam sterilized.

A preferred embodiment of the invention is formed from the KRATON G Series of durometer 40 which is readily colorable and easily molded. Chemical resistance is satisfactory and the material is considered safe for food applications by the Food & Drug Administration. As indicated above other materials could be used. RTV (room temperature vulcanizing) silicone rubber was tested, and while resistant to ozone and color stable it was found to be too fragile. Neoprene (chloroprene) is a good all around elastomer. EPDM (Ethylene-Propylene-Diene) is good for aging outdoors. Nitrile/PVC provides extra resistance to oil and gasoline but not so good for ozone. VITON (a fluoroelastomer) has good resistance but lower extensibility. Variations of natural rubber, gum rubber or latex rubber are also acceptable materials.

Accordingly, the present invention has been described with some degree of particularity directed to preferred embodiments of the present invention. It should be appreciated, though, that the present invention is defined by the following claims construed in light of the prior art so modifications or changes may be made to preferred embodiments of the present invention without departing from inventive concepts contained herein.

What is claimed is:

1. A handle retaining apparatus comprising:

an elastic ring having a cross section having a straight perimeter section, to provide a flat surface which lies next to a handle wherein said ring has an inner diameter of between 0.35 and 0.80 cm and an outer diameter of between 0.60 and 1.25 cm.

2. A handle securing apparatus comprising:

a ring having an inner diameter, an outer diameter, and a thickness, wherein the ratio of said inner diameter to said outer diameter is less than 0.85, the ratio of the thickness of said ring to said outer diameter is between 0.030 and 0.040, and said ring is made of a material having an extensibility of between 75% and 300%.

* * * * *